US005138781A

United States Patent [19]

Claver

[11] Patent Number: 5,138,781

[45] Date of Patent: Aug. 18, 1992

[54] MULTIFACED VARIABLE DISPLAY DEVICE

[75] Inventor: Wiley P. Claver, Irving, Tex.

[73] Assignee: Quadra View Incorporated, Tulsa, Okla.

[21] Appl. No.: 641,765

[22] Filed: Jan. 16, 1991

[51] Int. Cl.[5] ..... G09F 11/12

[52] U.S. Cl. ..... 40/524; 40/472

[58] Field of Search ..... 40/524, 472, 467, 525–529, 40/518

[56] References Cited

U.S. PATENT DOCUMENTS

| | | | |
|---|---|---|---|
| 279,936 | 6/1883 | Gokey | 40/472 |
| 785,736 | 3/1905 | Jacobs | 40/472 |
| 930,963 | 8/1909 | Hosaka | 40/524 X |
| 1,484,231 | 2/1924 | Pistocco . | |
| 2,192,257 | 3/1940 | Champion et al. | 40/525 X |
| 2,266,724 | 12/1941 | Goldberg et al. . | |
| 2,794,280 | 6/1957 | Duty . | |
| 2,943,408 | 7/1960 | Downs . | |
| 3,497,978 | 3/1970 | Miller, Jr. et al. . | |
| 3,585,745 | 6/1971 | Llobet . | |
| 3,605,302 | 9/1971 | Muller . | |
| 3,664,050 | 5/1972 | Manzano . | |
| 3,729,731 | 4/1973 | Konnerth et al. . | |
| 3,735,513 | 5/1973 | Constant, Jr. et al. . | |
| 3,754,342 | 8/1973 | Santacroce et al. . | |
| 3,824,721 | 7/1974 | Burns . | |
| 3,849,919 | 11/1974 | Gravelle et al. . | |
| 4,005,535 | 2/1977 | Davis . | |
| 4,084,337 | 4/1978 | Tucker | 40/472 |
| 4,176,483 | 12/1979 | Bailey | 40/467 |
| 4,201,002 | 5/1980 | Barton | 40/524 |
| 4,296,562 | 10/1981 | Sanborn . | |
| 4,333,255 | 6/1982 | Ward | 40/524 |
| 4,739,567 | 4/1988 | Cardin . | |
| 4,759,140 | 7/1988 | Roberts et al. . | |
| 4,771,558 | 9/1988 | Roberts et al. . | |
| 4,805,331 | 2/1989 | Boggess et al. . | |
| 4,827,644 | 5/1989 | Trame | 40/472 |

FOREIGN PATENT DOCUMENTS

| | | | |
|---|---|---|---|
| 214587 | 3/1987 | European Pat. Off. | 40/524 |

*Primary Examiner*—Kenneth J. Dorner
*Assistant Examiner*—J. Bonifanti
*Attorney, Agent, or Firm*—Head & Johnson

[57] ABSTRACT

A multifaced dispaly apparatus having four flexible display panels detachably connected at their ends to form a continuous display web. A frame includes two windows to simultaneously display two of the display panels. A roller mechanism includes a plurality of rollers, each roller parallel with the others and arranged so that the display web travels about the rollers and the panels are sequentially brought into alignment with the windows. A tensioning mechanism retains the continuous display web in a taut position. A drive mechanism is detachably secured to the display panels in order to move the continuous display web about the rollers. A control mechanism controls the drive mechanism and sequentially moves the display panels into and out of windows.

4 Claims, 4 Drawing Sheets

MULTIFACED VARIABLE DISPLAY DEVICE

BACKGROUND OF THE INVENTION

1. Field of the Invention

The present invention relates to scrolling display devices having a continuous web wherein the display may be periodically changed. In particular, the present invention relates to scrolling display devices having two viewing windows providing two simultaneous displays.

2. Prior Art

Scrolling sign displays which periodically change the advertising message are well known. A web which contains the advertising message may be scrolled and brought up to a window or viewing area. Accordingly, a number of different messages may be displayed. Likewise, highway signs having two faces aligned back to back, that may be seen from either direction, are well known.

Examples of prior art include Burns (U.S. Pat. No. 834,721). A continuous chain is driven from which display panels are suspended. A clutch is periodically energized to bring one of the panels in front of a single display area. Since there is only a single display area, no provision is made for aligning two display panels for viewing at the same time.

Downs (U.S. Pat. No. 2,943,048) provides a display device having a single display area wherein a plurality of display panels alternate on tracks from a front display position to a rear storage position.

Duty (U.S. Pat. No. 2,794,280) discloses a single display area having a pair of moving bands in the form of driving chains positioned to travel endlessly with signs fixed at spaced points along the band.

Goldberg et al. (U.S. Pat. No. 2,266,724) provides a display device having two display faces and a continuous chain that carries a series of letters in front of the display faces. While two display windows are utilized, the display is directed to the scrolling message and, hence, no provision is made or need be made for aligning two discrete panels.

Llobet (U.S. Pat. No. 3,585,745) illustrates a display device having two faces. A drive arrangement moves all display bands at the same time and a rotatable drum provides a plurality of curved surfaces upon which visual elements move through viewing positions. Again, the problem of aligning two discrete faces at one time is not presented.

Accordingly, it is a principal object and purpose of the present invention to provide a scrolling display device having two separate viewing windows wherein a number of discrete messages on a continuous web may be scrolled so that a message may be viewed in each window.

SUMMARY OF THE INVENTION

A multifaced variable display device includes a frame having a pair of display windows. The windows are opposed to each other, aligned back to back and parallel.

Within each window, one of a series of four display panels would be visible. Each display panel would be of equal length and have a discrete message. Each display panel is flexible, translucent, and connected at its ends to adjacent display panels. With the display panels so connected, a continuous display web is formed. The panels are detachably connected to each other.

The continuous web, consisting of the individual panels connected end to end, is allowed to scroll into a window so that the individual panels are sequentially displayed. A pair of rollers is mounted near the ends of the each window so that the web will stretch across the rollers and display the message.

Each roller is arranged parallel to the other rollers. While two of the panels are being displayed in the windows, the remaining two panels are retained within the frame between the opposed windows. An additional roller is mounted within the frame parallel to the other rollers. After a panel scrolls across the two windows, it will pass interior to the opposed windows around the additional roller before returning to the window. The panels not being displayed travel interior to the path of the panels being displayed. The panels not being displayed would travel a shorter distance than the panels traveling across the windows. Accordingly, an additional set of rollers is provided so that the distance a panel travels as it passes the windows is equal to the distance the panel travels interior to the opposed windows.

A tensioning mechanism is provided on one roller which is mounted on tensioning blocks. The blocks in turn are connected to the frame by springs which provide a constant tension to the roller.

The continuous web is driven by a drive mechanism including a motor connected to a gear box. The output of the gear box is connected by chain or belt to a shaft of one of the rollers. The driving force of the motor is, thus, transferred to the rollers and, in turn, to the display web.

A pair of continuous chains navigate the path of the continuous web about the rollers. The chains travel about sprockets mounted on shafts of the rollers.

The individual panels are removably connected to the chains by swivel type springs. Tabs extend from the continuous chains and receive the springs. The opposite end of each spring is connected to a display panel.

Additional tabs extend from one of the chains. As the tab travels about the sprocket, it passes a sensor controlled mechanical contact switch. A programmable computer will deactivate the motor so that the panel will stop in a position aligned with one of the windows. After a given period of time, the motor will be activated and the cycle will be repeated.

DETAILED DESCRIPTION OF THE PREFERRED EMBODIMENTS

Figure 1:
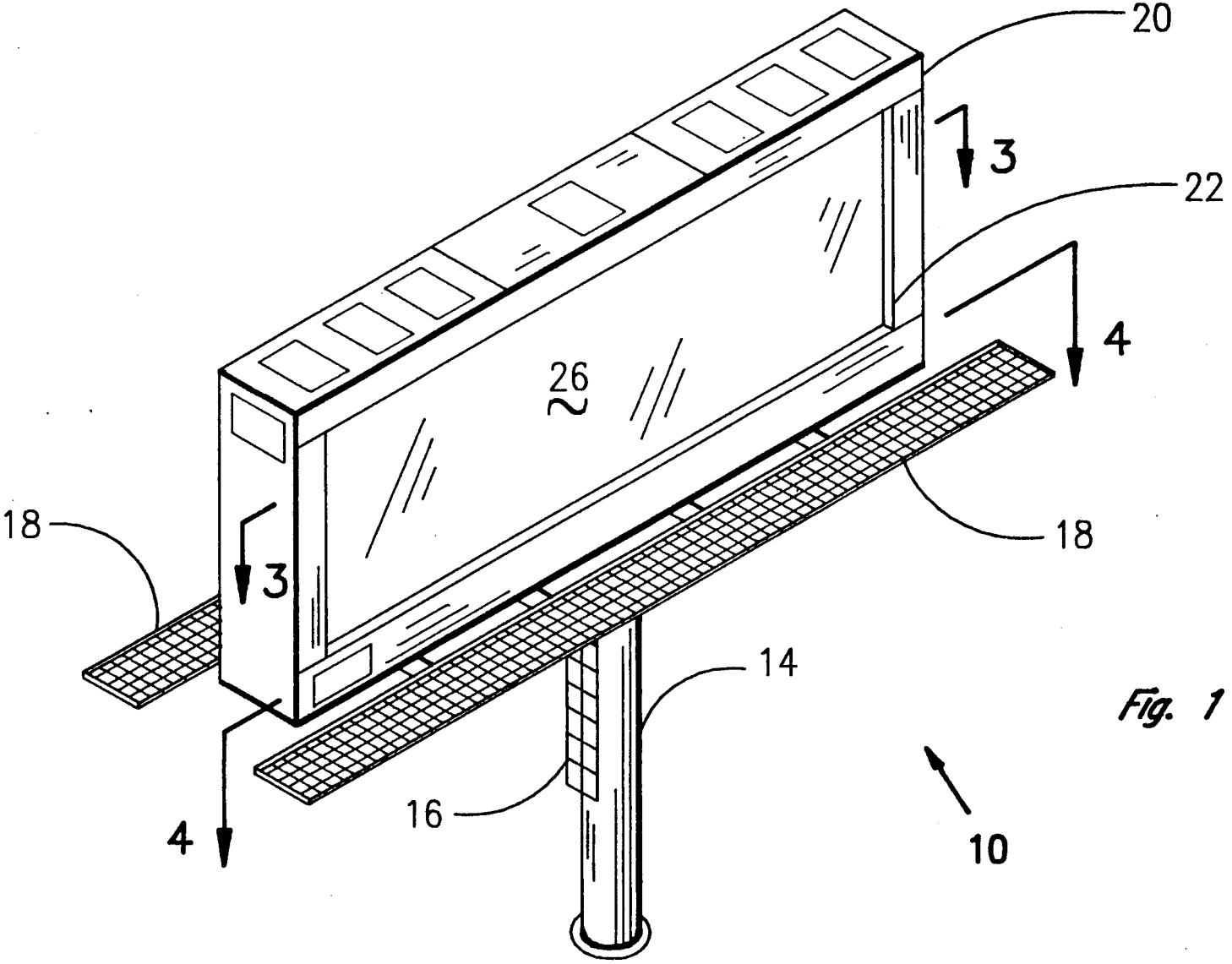
FIG. 1 is a perspective view of a multifaced variable display device constructed in accordance with the present invention.

Referring to the drawings in detail, FIG. 1 is a perspective view of a variable display device 10 constructed in accordance with the present invention. The device may be mounted alongside of a roadway (not shown) so that it is visible to traffic from both directions.

The device might be mounted above the level of the roadway on a pole 14 and accessed by a ladder 16. Extending walkways 18 near the top of the pole might also be utilized to service the display device. It will be understood that the device might be mounted in other ways, such as on the top of a building.

The device itself includes a frame 20 mounted on the top of the pole. The frame 20 has a pair of display windows 22 and 24 (one of which is visible is FIG. 1). In the embodiment shown, the windows would be opposed to each other, aligned back to back and parallel to each other. Accordingly, one window would be visible to traffic coming from one direction while the other window would be visible to traffic coming from the opposite direction.

Within each window, one of a series of four display panels 26, 28, 30, and 32 would be visible. Each display panel would be of equal length. In FIG. 1, display panel 26 can be seen. Each display panel will have a discrete message, such as an illustration and text advertising a particular product. By way of example, the panels might carry advertising for an automobile, a restaurant, a department store and a bank.

Each display panel is flexible and translucent. A commercially available material which has been found to be satisfactory is Panaflex TM manufactured by 3M of St. Paul, Minnesota. This material consists of a polyester scrim embedded between two layers of white pigmented vinyl and has a thickness of approximately 0.05 centimeters. The material may be painted or printed on. The average light transmission through the material is 30% so that backlighting will illuminate the panel.

Figure 2:
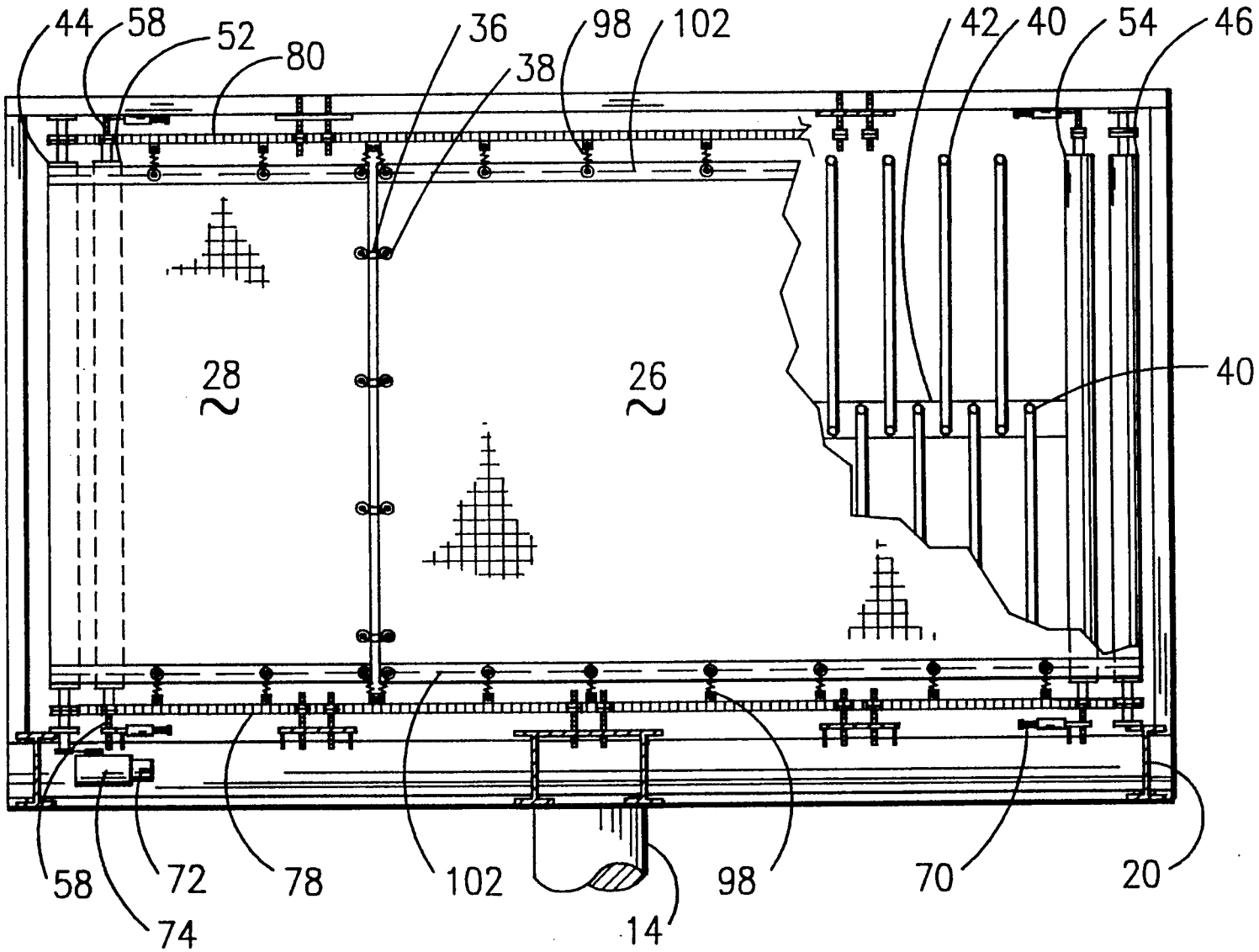
FIG. 2 is a multifaced variable display device constructed in accordance with the present invention having a portion of the frame removed at one of the windows.

FIG. 2 illustrates the device 10 with a portion of the frame 20 removed at window 22 to reveal display panels 26 and 28. While window 22 is shown and discussed herein, it will be appreciated that a similar arrangement is provided for window 24. Each display panel is connected at its ends to adjacent display panels. Display panel 26 is connected at one end to display panel 28 and at its opposite end (not seen in FIG. 2) to display panel 32. With the display panels so connected, a continuous display web 34 is formed.

The panels are detachably connected to each other by wire ties 36 threaded through grommets 38, the ties being removable in the event one of the display panels is to be replaced. Other types of detachable connectors might also be utilized to connect the panels, provided they are durable enough to withstand the movement of the panels, as will be described, and the forces exerted by wind and temperature variations.

The individual panels 26, 28, 30, and 32 will be replaced not only for repair and service but to change the advertising message on the panel.

Display panel 26 is also partially cut away in FIG. 2 to reveal a series of fluorescent light bulbs 40. The bulbs do not extend behind the entire window but are staggered and slightly overlapping at their ends. The bulbs are retained in place by light can fixtures 42 and are wired to a standard electric supply (not shown). As arranged, the bulbs provide backlighting for the panel displayed in the window 22 without any dark or "cold" spots.

The continuous web 34, consisting of the individual panels connected end to end, is allowed to scroll into the window 22 so that the individual panels 26, 28, 30, and 32 will be sequentially displayed. A pair of rollers 44 and 46 are mounted near the ends of the window 22 so that the web will stretch across the rollers 44 and 46 and will display the message through the window.

Figure 3:
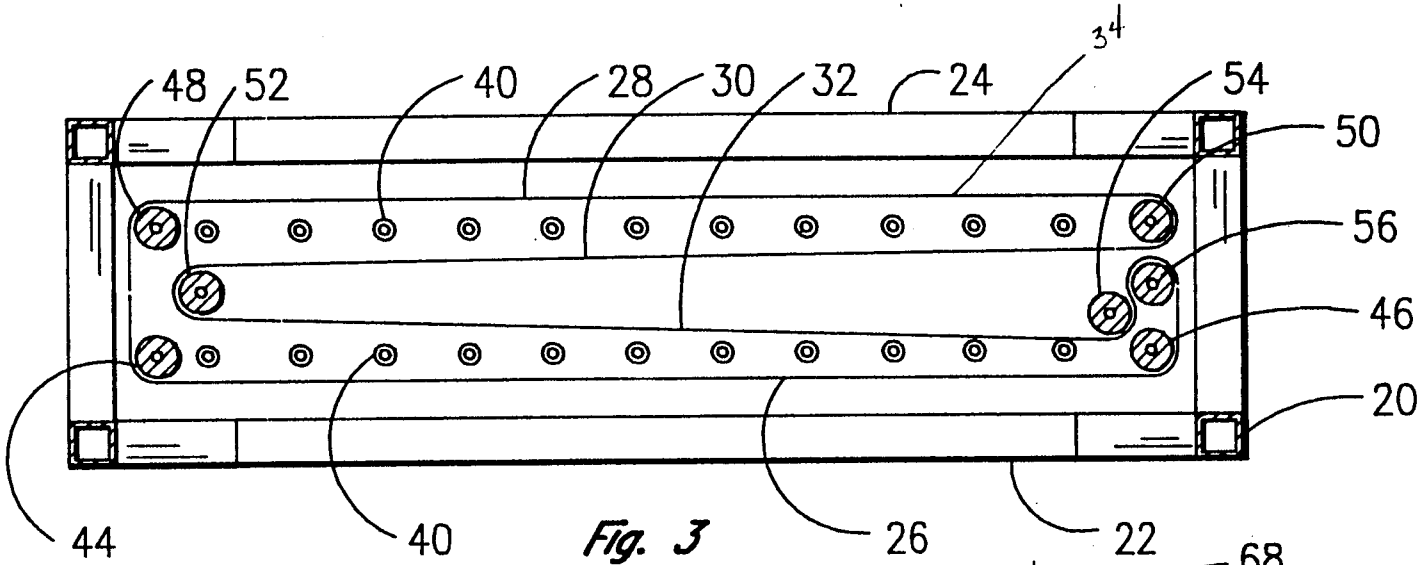
FIG. 3 is a sectional view taken along section line 3—3 of FIG. 1.

With reference to FIG. 3 and continuing reference to FIG. 2, it will be seen that the panels will be allowed to sequentially scroll past window 24 in the same manner. A pair of rollers 48 and 50 are mounted near the ends of the window 24 so that the continuous web will stretch across the rollers 48 and 50 and will display the message.

Each of the rollers 44, 46, 48 and 50 are arranged parallel to each other. While two of the panels 26 and 28 are being displayed in the windows, the remaining panels 30 and 32 are retained within frame 20 between the opposed windows. Roller 52 is mounted within the frame 20 parallel to the rollers 44, 46, 48 and 50. Accordingly, after each panel scrolls across each window, it will pass interior to the opposed windows around roller 52 before returning again to the first window.

The path of the panels 26, 28, 30 and 32 can readily be observed from the sectional view in FIG. 3. Assuming that the movement of panel 26 in window 22 is from right to left, panel 26 will move from window 22 into window 24. At the same time, the other panels that form the continuous web will also move in the same direction. Thereafter, panel 26 will move interior to the opposed windows about roller 52. Subsequently, panel 26 will return to window 22 to repeat the process. From the foregoing, it can be seen that two of the panels will be displayed in the windows while the remaining two panels will be interior to the windows and not visible.

The panels not being displayed travel interior to the periphery of the path of the panels being displayed. It will be observed that the panels not being displayed would travel a shorter distance than the panels traveling across the windows. For this reason, rollers 54 and 56 are provided so that the distance that a panel travels as it passes the two windows is equal to the distance the panel travels interior to the opposed windows.

It will be appreciated that the direction of movement of the panels is dependant upon the drive mechanism, to be discussed, and might be reversed from that discussed herein.

Figure 4:
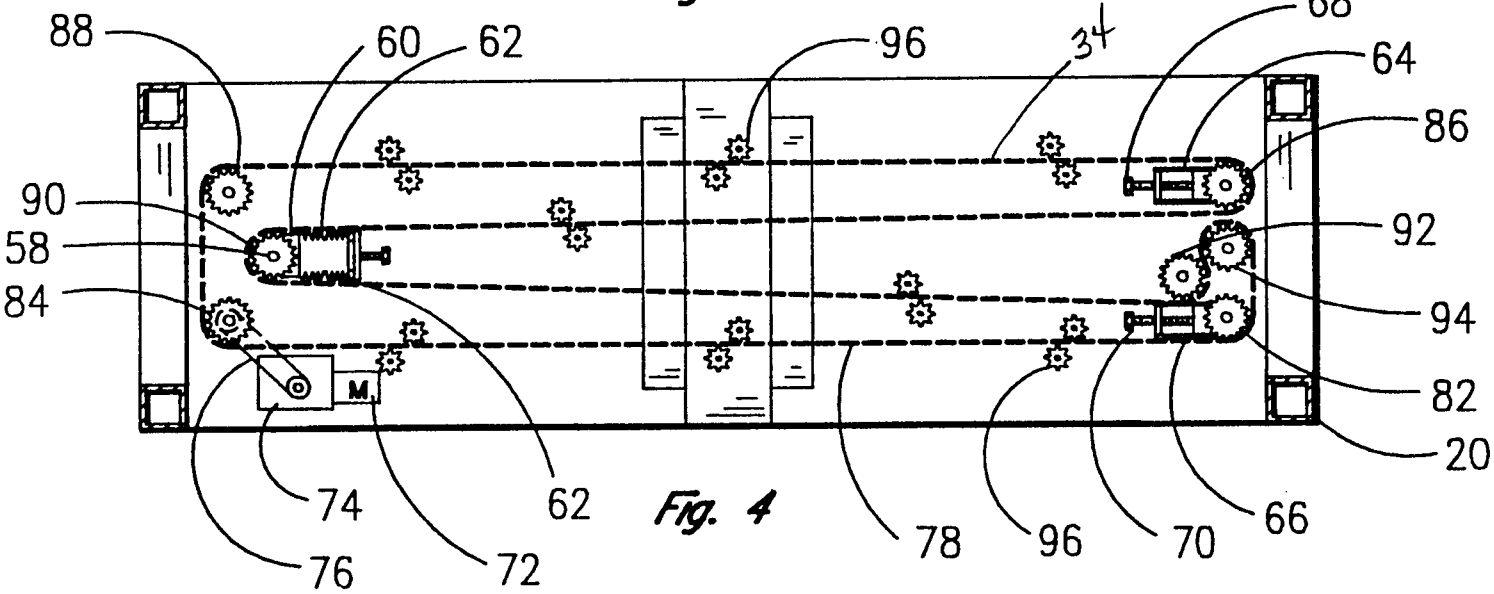
FIG. 4 is a sectional view taken along section line 4—4 of FIG. 1.

FIG. 4 is a sectional view taken along section line 4—4 of FIG. 1. Roller 52 provides a tensioning mechanism to assure that each panel forming the continuous web will remain taut against the rollers, yet not bind. Due to variations in the atmospheric temperature, it has been found that the panels will stretch and shrink up to one inch. Roller 52 terminates at each end in a shaft 58 which is mounted on tensioning blocks 60. Between the frame 20 and the blocks 60 are springs 62 which provide a constant tension in a direction perpendicular to the axes of the rollers. Accordingly, as the panels stretch, the springs will displace the blocks 60 and roller 52. As the panels shrink, the roller 52 will move in the opposite direction. The tensioning mechanism will, thus, automatically adjust to keep the web taut.

The relative position of rollers 50 and 46 may also be adjusted. Take-up frames 64 and 66 may be adjusted through rotation of threaded bolts 68 and 70. This adjustment would normally be made at the time of installation.

The continuous web is driven by a drive mechanism that includes a motor 72 (shown diagrammatically with the symbol M) connected to a gearbox 74. It has been found that a 3 phase 220 volt electric motor with a gearbox having a gearing ratio of approximately 50 to 1 is suitable. The output from the gearbox 74 is connected by a chain or belt 76 to a shaft of roller 44. It will, thus, be observed that the driving force of the motor is transferred to the rollers and, in turn, to the web. When the motor is halted, the gearing of the gearbox acts to quickly brake the rollers and web. The web is, thus, prevented from coasting to a stop.

Returning to a consideration of FIG. 2 and with continuing reference to FIG. 4, a pair of continuous chains 78 and 80 navigates the path of the continuous web about the rollers. The chain 78 is depicted in FIG. 4 by a dashed line.

The lower chain 78 travels about sprockets 82, 84, 86, 88, 90, 92 and 94 before returning to sprocket 82 to begin the cycle again. These sprockets receive the lower chain and are mounted on shafts which extend from each end of the rollers. Additionally, a plurality of idler sprockets 96 guide the chain. For clarity, only a few of the idler sprockets are shown in FIG. 4.

Figure 5:
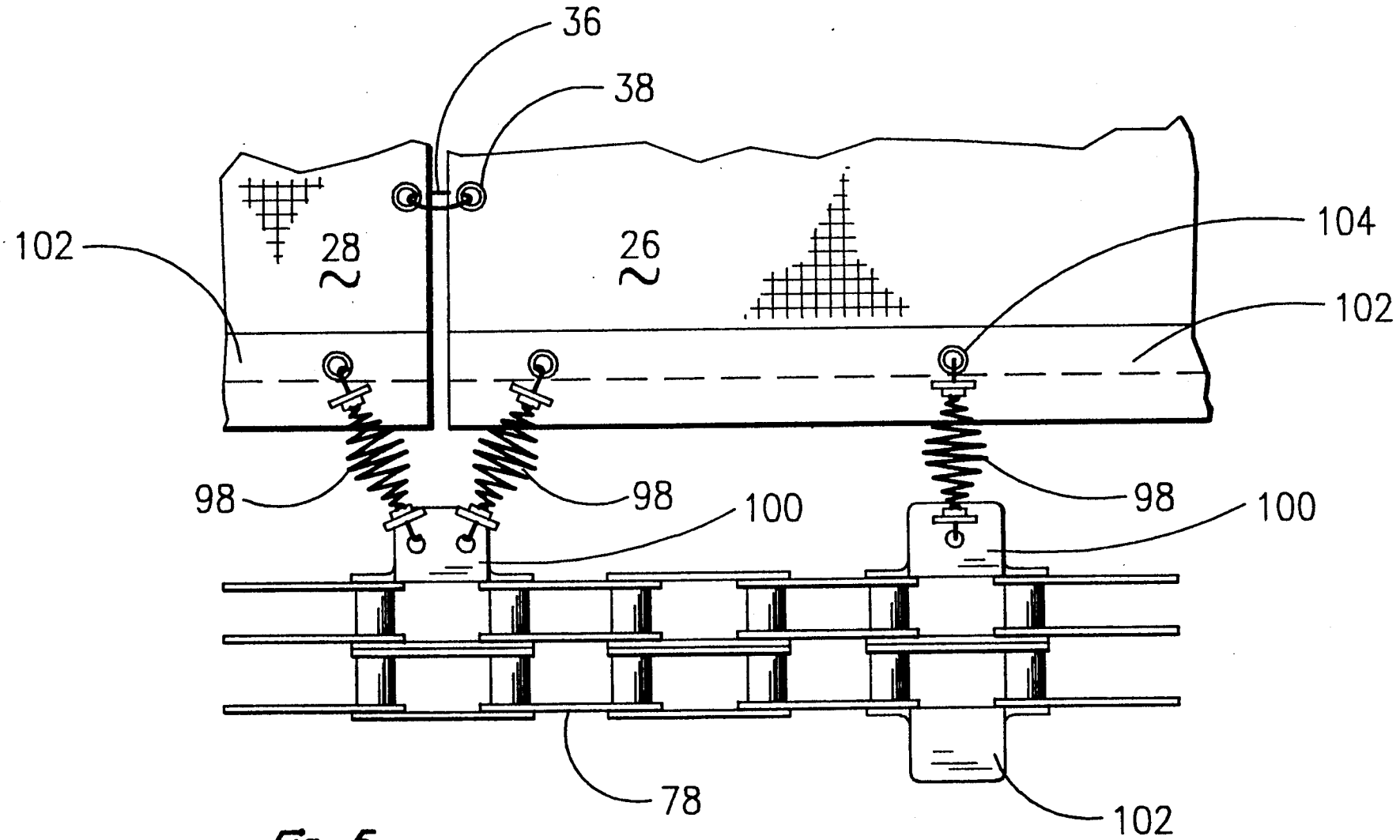
FIG. 5 is a partial view of two of the display panels and their attachment to a continuous chain of the multifaced variable display device seen in FIG. 1.

The panels are removably connected to the chains 78 and 80. As best seen in FIG. 5, a plurality of swivel type springs 98 extend between tabs 100 extending from the continuous chain 78 and the display panels 26 and 28. In order to provide strength and durability to this connection, a woven belt 102 is provided at the edge of each of the display panels through which grommets 104 are secured. Two springs 98 are mounted to a single tab 100 where the adjoining panels 26 and 28 meet. It has been found that the springs absorb some of the shock of starting and stopping.

In order to replace one of the panels in the continuous web, the wire ties 38 are disconnected so that the adjoining panels are separated. The springs 98 are next unhooked from the panel. The panel will then be detached from the web and may easily be removed. Since the remaining panels are suspended from the top chain 80, the remaining panels remain supported and in place. A new panel may then be installed. The springs 98 are extended between the panel and the tabs 100. The wire ties are threaded through the grommets and secured. The other panels can be replaced in a similar fashion. FIG. 3 illustrates a preferred arrangement for illuminating the display device. The bulbs 40 are mounted in the frame so that the display panels in each of the windows 22 and 24 are backlighted.

Returning to a consideration of FIG. 5, an additional tab 102 extends from the chain 78 opposite the tabs 100. As the tab 102 travels about the sprockets, it passes a sensor controlled mechanical contact switch. When the sensor indicates that a panel has moved into a correct position in a window, a programmable computer (not shown) deactivates the motor 72 so that the web will stop. After a given period of time as determined by a clock mechanism in the computer, the computer will again activate the motor and the cycle will be repeated. One tab 102 is provided for each display panel. It will be understood that the functions of the tab 102 and the sensing mechanism may be carried out in a variety of other ways.

The present invention provides a variable display device that allows an operator a choice of messages to be displayed for a selected period of time. By way of example, it may be desired to display one of the panels for a period of time twice the duration of the other panels. One panel could be displayed for 40 seconds while the other panels are displayed for 20 seconds.

Whereas, the present invention has been described in relation to the drawings attached hereto, it should be understood that other and further modifications, apart from those shown or suggested herein, may be made within the spirit and scope of this invention.

What is claimed is:

1. A multifaced display apparatus which comprises:

(a) at least four flexible display panels detachably connected at their ends to form a continuous display web;

(b) a frame having a first window and an opposed second window, each window to display one of said display panels;

(c) a first pair of rollers adjacent said first window so that said web travels about said first pair of rollers and said panels are sequentially brought into alignment with said first window;

(d) a second pair of rollers adjacent said second window so that said web travels about said second pair of rollers and said panels are sequentially brought into alignment with said second window;

(e) a pair of spacing rollers juxtaposed between said first pair of rollers and said second pair of rollers within said frame; and (f) an offset roller parallel to said spacing rollers to increase the distance that said web travels within said frame when not displayed in said windows whereby said web travels around one of said spacing rollers, then around said offset roller and then around said other spacing roller so that the linear distance travelled by said panels while not displayed in said windows is equal to the length of two panels.

2. A multifaced display apparatus as set forth in claim 1 wherein said display faces are parallel and opposed to each other and adjoining panels will be displayed in said display faces.

3. A multifaced display apparatus as set forth in claim 1 wherein one of said spacing rollers extends between a pair of blocks, and including spring means extending between said blocks and said frame, said spring means providing a force perpendicular to said spacing roller.

4. A multifaced display apparatus as set forth in claim 1 including drive means detachably secured to said continuous display web, said drive means including motor means and a pair of continuous chains that travel about sprockets extending from said rollers, said chains being detachably secured to said panels by detachable springs.

* * * * *